United States Patent [19]

Goldstein et al.

[11] Patent Number: 4,898,531

[45] Date of Patent: Feb. 6, 1990

[54] PHOTOSENSITIVE CONTROL OF ELECTRICALLY POWERED EMISSIVE IGNITION DEVICES

[75] Inventors: Mark K. Goldstein, La Jolla; Earl M. Dolnick, Encinitas, both of Calif.

[73] Assignee: Quantum Group, Inc., San Diego, Calif.

[21] Appl. No.: 227,083

[22] Filed: Aug. 1, 1988

Related U.S. Application Data

[63] Continuation-in-part of Ser. No. 101,038, Jul. 3, 1984, Pat. No. 4,263,791, Ser. No. 659,074, Oct. 5, 1984, abandoned, Ser. No. 517,699, Jul. 25, 1983, abandoned, Ser. No. 693,869, Jan. 22, 1985, abandoned, Ser. No. 937,609, Dec. 3, 1986, abandoned, Ser. No. 701,369, Feb. 13, 1985, abandoned, and Ser. No. 48,961, May 11, 1987, Pat. No. 4,793,799.

[51] Int. Cl.[4] ..... F23N 5/08

[52] U.S. Cl. ..... 431/12; 431/79

[58] Field of Search ..... 431/6, 12, 66, 74, 79; 340/578; 250/339; 361/264

[56] References Cited

U.S. PATENT DOCUMENTS

| | | | |
|---|---|---|---|
| 2,460,314 | 2/1949 | Thomson | 431/79 |
| 3,046,406 | 7/1962 | Dietker | 431/79 X |
| 3,537,804 | 11/1970 | Walbridge | 431/66 |
| 3,574,496 | 4/1971 | Hewitt | 431/79 X |
| 3,765,820 | 10/1973 | Ito et al. | 431/79 X |
| 3,980,420 | 9/1976 | Baysinger et al. | 431/66 X |
| 4,131,413 | 12/1978 | Ryno | 431/44 |

FOREIGN PATENT DOCUMENTS

| | | | |
|---|---|---|---|
| 197801 | 3/1978 | France | 431/79 |

*Primary Examiner*—Randall L. Green

*Attorney, Agent, or Firm*—Christie, Parker & Hale

[57] ABSTRACT

The system utilizes a radiation sensing device which views an electrically heated emissive igniter to provide proof-of-ignitability detection of the igniter. Optimally a photovoltaic array may be employed to self-power the electronic circuitry and fuel intake valve to the burner of a combustion device. In one embodiment there is also provides a second emission device viewed by the first photovoltaic array or a second photovoltaic device which views a second emissive device which is thermally heated upon activation of the burner. The electronic signals generated by the second light sensing device can be used to prove ignition of the combustion gases. When the second light sensing device is a photovoltaic array, power may be generated for recharging a storage battery, which in turn, can be used to electrically heat the emissive igniter. In the simpler case where the second emissive device is powered by the gas flame, means are provided for turning off the igniter. Thermal sensing may be provided to verify temperature of the system. The system thereby provides a means for affording the significant safety features of proof-of-ignitability and proof-of-ignition to a combustion apparatus.

19 Claims, 2 Drawing Sheets

PHOTOSENSITIVE CONTROL OF ELECTRICALLY POWERED EMISSIVE IGNITION DEVICES

CROSS REFERENCE TO RELATED APPLICATIONS

This invention is a continuation in part of our prior patent applications. This application is copending with applicants' prior applications entitled, "Photovoltaic Control Systems", PCT/US 84/101038, (U.S. Pat. No. 4,263,791,U.S. Ser. No. 659,074, (abandoned) filed July 3, 1984, and Oct. 5, 1984, respectively; applicants' abandoned application Ser. No. 517,699, filed July 25, 1983; applicants' application entitled "Photovoltaic Oxygen Depletion Sensor", Ser. No. 693,869, filed Jan. 22, 1985 (abandoned); applicants' application entitled "Self-Powered Intermittent Ignition and Control System for Gas Combustion Appliances", Ser. No. 937,609 filed Dec. 3, 1986 (abandoned); "Photovoltaic Controlled Electronic Valves", Ser. No. 701,369, (abandoned) filed Feb. 13, 1985; "Photovoltaic Control Systems", Ser. No. 048,961, (U.S. Pat. No. 4,793,799) filed May 11, 1987; and the patent disclosure "Photovoltaic Controls and Electrically Powered Emissive Ignition Devices", Disclosure Document No. 135523, filed Mar. 1, 1985, and collected into the later patent applications mentioned above. The full text of these applications are incorporated herein by reference.

FIELD OF THE INVENTION

This invention relates generally to photovoltaic control of combustion devices and more particularly to improved control systems which utilize electrically powered emissive ignition devices.

BACKGROUND OF THE INVENTION

The present invention is distinguished from other control systems such as flame rectifiers, photocell systems, and spectroscopic analyzers, which provide a means for detecting the ignition of fuel in a combustion device. Flame rectifiers such as described by Smith, et al., U.S. Pat. No. 2,748,846, and by Serber, U.S. Pat. No. 4,405,299 have been used for obtaining response to flame failure, but these systems are expensive, require external power and have maintenance problems due to corrosion. Ito, et al., U.S. Pat. No. 3,765,820 describe a combustion apparatus having a gas heated element disposed within, and projecting above, a burner plate. The light emitted from the luminous element is detected by an externally powered photosensing circuit and is used to control the efficiency of combustion. A similar method is described by Gulitz, U.S. Pat. No. 4,059,385. None of these methods provide proof-of-ignitability detection.

Walbridge, U.S. Pat. No. 3,537,804 describes the use of a photoelectric element that senses radiation emitted by a hot-wire igniter. The circuitry can be used to regulate the flow of fuel or the temperature of the igniter. French patent No. 76-20296 describes an emissive ignition coil located above a quartz rod connected to a fiber optic which performs in a manner to control the burner as well as ignition. Other flame detecting devices have been described using emissive means and optical sensing mechanisms including the Japanese patent of Kurosawa, No. 55-51230. N. Mitsugu received a Japanese patent, No. 52-30921, on a similar flame detecting device designed to prevent problems with soot.

Ryno, U.S. Pat. No. 4,131,413 describes a self-contained spark igniter activated by a storage battery rechargeable by multiple thermopile generators.

A need exists for a failsafe control mechanism that is faster and more reliable than the devices described in the prior art and which can power a solenoid fuel intake valve as well as power its own electronic circuits. It is desirable that there be no possibility of fuel flow before there is proof that such fuel will ignite.

This invention provides an apparatus and method which accomplishes these goals at reduced costs. This invention involves several novel embodiments of our earlier patent application No. PCT/US 84/101038 filed July 3, 1984, and puts forth several new uses and improvements, e.g. combining our new proof of ignitability and proof of ignition features with our earlier carbon monoxide safety, fast shutoff invention.

SUMMARY OF THE INVENTION

The present invention utilizes a photosensitive material such as a photocell or photovoltaic array which views an electrically heated emissive igniter. In the case of a photovoltaic array, the power generated by the array drives the electronic circuitry required to prove the igniter has reached sufficient temperature to ignite fuel emerging from a burner. Furthermore, power generated by the photovoltaic array may be used to electrically power the fuel inlet valve to the burner. Accordingly, this invention provides substantial freedom of the combustion device from external power sources as well as significant safety features such as proof of igniter temperature (proof-of-ignitability) prior to burner activation.

This invention also provides for the inclusion of a second photosensing device, such as a phototransistor or photovoltaic array, located remotely from the igniter, which is arranged to receive radiation from a second emissive device. This device is most desirable if large rows of burners are used. Upon activation of the burner and ignition of the combustion gases, the second emissive device is thermally heated to a suitable temperature. Radiation from the thermally heated emitter is converted to electrical power by the second photovoltaic device. The voltage or power generated by the second emissive element can be used to prove the occurrence of combustion gas ignition. Accordingly, significant safety features such as rapid proof-of-ignition, and fast burner shutdown in the event of flame failure, are provided.

The method may also be used to self-power the electrically heated emissive igniter by means of a storage battery, as well as to provide control of burner combustion efficiency and turn off power to the igniter once ignition has occurred. The invention thereby provides a means for generating electrical power that can make the combustion apparatus completely independent of external power sources.

DESCRIPTION OF PREFERRED EMBODIMENTS

Figure 1:
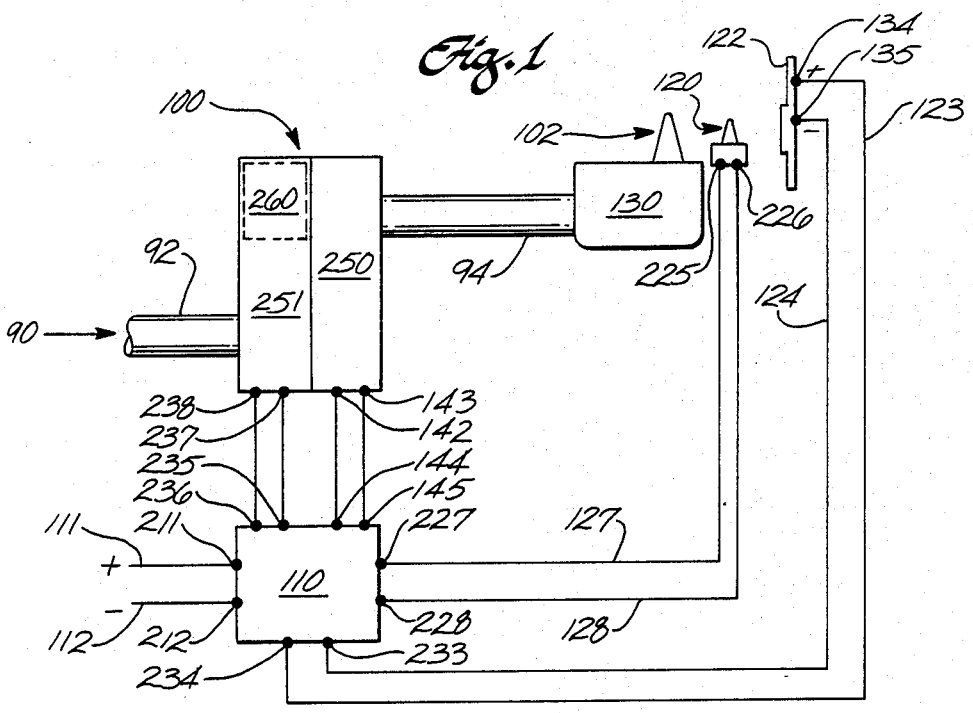
FIG. 1 is a schematic diagram depicting photovoltaic sensing and operation from radiation from an electrically powered emissive igniter and control of a valve regulating the flow of gas to a burner.

The interaction of components in this invention for providing the proof-of-ignitability safety function is depicted in FIG. 1. External power provided by leads 111 and 112 to terminals 211 and 212 on a controller 110 may be used, e.g. by a manual or thermostatically controlled switch, to electrically heat an igniter 120 via leads 127 and 128 connected to terminals 227 and 228 on the controller 110 and to terminals 225 and 226 on the igniter. The external power provided to the controller may be derived from a rechargeable storage battery 240 connected to a photovoltaic array 230 (FIG. 2) or by conventional utility line power.

Either external power, via leads 111 and 112, or self-power, generated by a photovoltaic array 122, via leads 123 and 124 connected to terminals 134 and 135 of the photovoltaic array and terminals 234 and 233 of the controller supplies power to the controller. Contained in the controller is conventional circuitry able to determine when the igniter has reached ignitability temperature by monitoring the power or voltage generated by the photovoltaic array as a result of irradiation from the emissive heater element 120. The electrically heated emissive heater element provides ignition of fuel gas for the appliance burner.

When such proof-of-ignitability condition has been obtained, the controller passes current generated from the photovoltaic array 122 via terminals 144, 145, 235 and 236 on the controller to terminals 142, 143, 237 and 238 on a fuel control valve 100, in which are located solenoids 250 and 251 or other electro-mechanical devices for operating the valve.

Upon reaching sufficient current, the solenoids 250 and 251 open, thereby permitting combustion gas to pass from an intake line 92 to a burner line 94 and thence to a burner 130, whereupon ignition of the gas occurs due to contact with hot igniter 120. An optional latching magnet 260 may be provided in valve 100 if desired. This latching magnet may be self-powered by the photovoltaic array to provide rapid, failsafe flame failure shutoff. Such electronic control of the valve operation prevents hazardous situations which would occur if gas were supplied to the burner before the igniter has reached ignition temperature or after an ignition attempt has failed. An emissive element 102 may also be provided in the flame of the burner 130 for providing additional radiation for the photovoltaic array for producing more power than available from radiation from the igniter alone. Further, use of an additional emissive element permits the igniter to be turned off after ignition has occurred. The emissive element also provides proof of continued combustion and connection to the controller can provide for fast shut off of fuel flow in the event the flame is extinguished.

Figure 2:
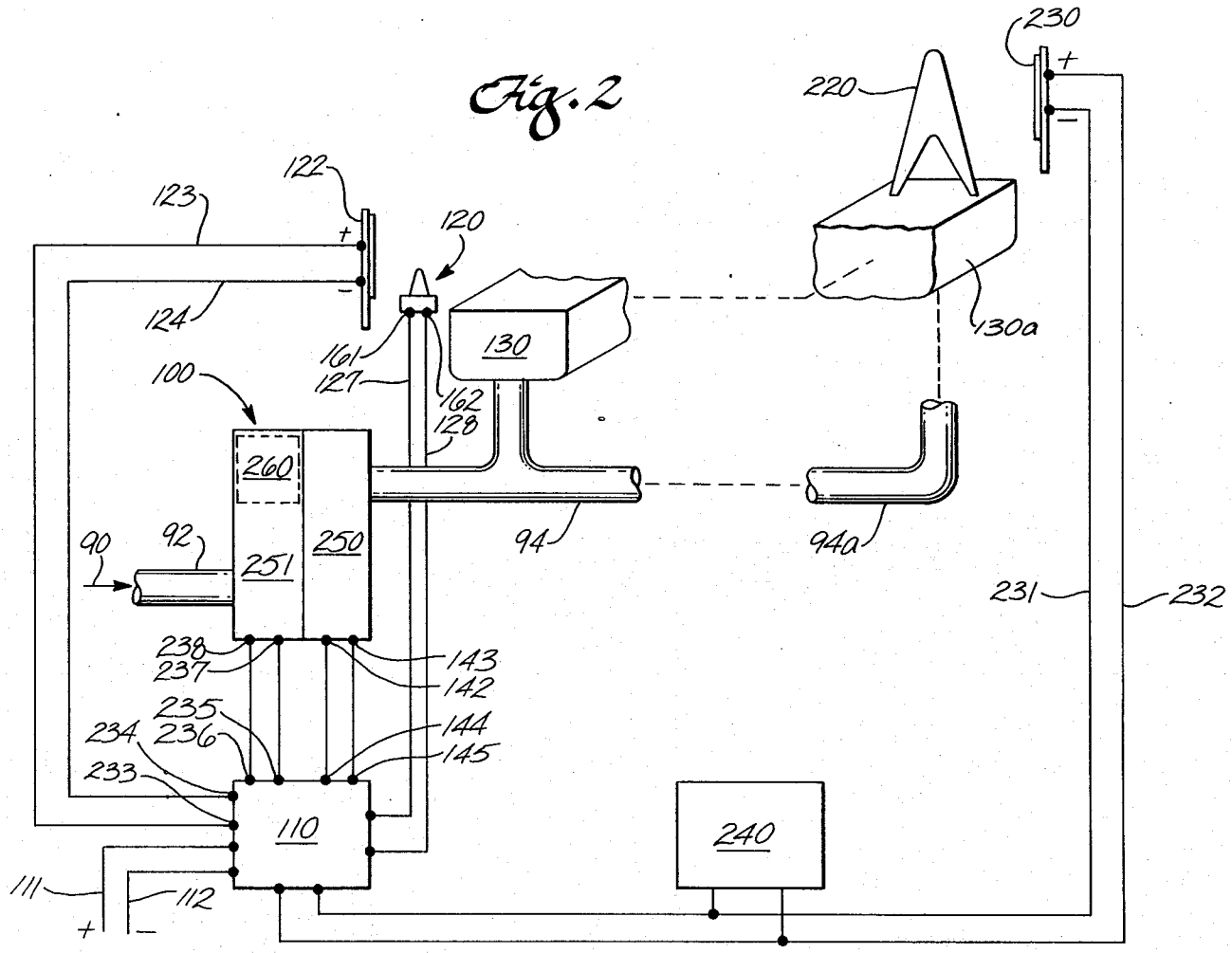
FIG. 2 is a schematic diagram depicting the same subject matter as that shown in FIG. 1 in addition to which is shown a means for sensing the event of combustion gas ignition through the use of a second photovoltaic device which receives radiation from a thermally heated emissive device.

Reproduced in FIG. 2 are the features depicted in FIG. 1 and described above. Additionally shown in FIG. 2 is a provision for detecting ignition of the combustion gases (proof-of-ignition) and for fast shutoff of the burner in the event of flame failure.

After ignition of gas on the burner 130 occurs, a flame front moves across the burner until it reaches the opposite end of the burner. For combustion apparatus having multiple burner rows, e.g. **130*a* fed by burner line 94*a*, the flame front spreads until the entire burner surface is ignited. A second emissive element 220 may be positioned over such an additional burner 130*a* as shown in FIG. 2. Alternatively, the entire burner may be emissive (not shown). The second emissive element 220 emits radiation as it increases in temperature. A second photovoltaic array 230 converts light energy falling on it from the second emissive element, into electrical current which passes through leads 231 and 232 connected to terminals 241 and 242 on the photovoltaic array and terminals 161 and 162** on the controller.

Once the voltage, current or power (i.e. current times voltage) generated by the second photovoltaic array 230 reaches a predetermined value, it is deemed to have proven ignition of the burner gas. Upon reaching such proof-of-ignition condition, the controller comprises conventional circuits which perform any of the following functions: (1) shut off current to the igniter 120 once proof-of-ignition occurs; (2) shut off current to the fuel valve 100 if ignition is not proven within a predetermined period of time; (3) close the fuel valve whenever the second emitter 220 cools below a selected threshold, such as in the event of burner flame failure; and (optionally) (4) store electrical power by means of a rechargeable storage battery, for later use, e.g. to electrically heat the igniter 120. A single photovoltaic array may be used to reduce cost.

Figure 3:
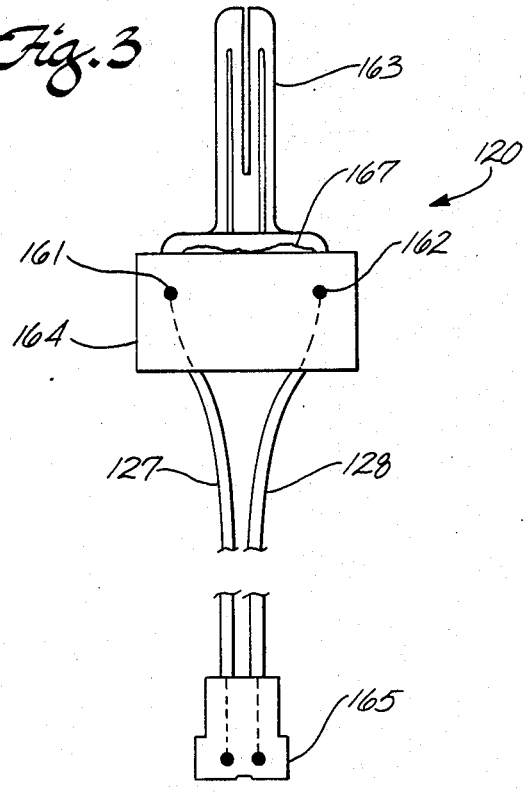
FIG. 3 is a representation of a commercially available electrically powered emissive igniter.

The igniter 120 comprises an electrical resistance igniter 163 such as a silicon carbide igniter available from Norton Company, Worcester, Mass., or The Carborundum Co, Niagara Falls, N.Y., and shown semi-schematically in FIG. 3. Key features of the igniter include a connector 165 for connecting the igniter to its terminals 225 and 226 (FIG. 1), and the heated element 163 made of, for example, machined silicon carbide or similar material. The heater element in a typical embodiment comprises an M-shaped flat sheet of silicon carbide Another geometry of heater element comprises a helically slit hollow cylinder of silicon carbide. Such geometries lengthen the current flow path through the element and reduce the transverse cross section, thereby increasing element resistance. The silicon carbide igniter may be powered by 24 volt or 110 volt AC, or by current from a battery which is recharged from the photovoltaic cells.

Electric current passing through such a high resistance heater element raises its temperature well above the ignition temperature of the fuel gas used in the appliance. Radiation from the heater element illuminates the photovoltaic array. Proof of ignitability of the fuel is obtained because the temperature of the element sufficient to open the fuel valve is more than enough to ignite the fuel. Thus, the valve cannot be inadvertently opened before the element reaches the ignition temperature and the photovoltaic array has sufficient output to open the valve.

Advantages of using an electrically heated igniter over a standing pilot flame and emissive means described in our previous application No. PCT/US 84/101038 include improved resistance to high temperature and thermal cycling, energy saving, enhanced monitoring of igniter temperature (if required), commercial acceptance, and easy adaptability to direct ignition systems.

The invention may employ continuous or intermittent modes of operation of the igniter. Continuous operation is an extension of our earlier application, PCT/US 84/101038, with an electrical emissive igniter substituted for an emissive pilot. The intermittent mode of operation is an extension and combination of our earlier invention, Ser. No. 937,609.

What is claimed is:

1. A method for controlling a gas burning appliance comprising the steps of:
   passing current through an emissive igniter;
   generating a current and voltage from a photovoltaic device viewing the igniter; and
   opening a gas valve to a burner when the current and/or voltage from the photovoltaic detector exceed a threshold sufficient for opening the valve with no other source of electric power;
   heating an emissive element with a flame from the burner; and
   generating sufficient current and voltage from a second photovoltaic device viewing the emissive element for maintaining the valve open with no other source of electric power.

2. A method as recited in claim 1 further comprising closing the valve in the event the current and voltage from the second photovoltaic device do not reach a selected threshold in a selected interval.

3. A method as recited in claim 2 further comprising discontinuing current through the igniter when the current and voltage from the second photovoltaic device reach a selected threshold.

4. A method as recited in claim 1 further comprising discontinuing current through the igniter when the current and voltage from the second photovoltaic device reach a selected threshold.

5. A fuel control system for a burner comprising:
   an electrically resistive heater element for igniting fuel;
   an electrically actuated fuel control valve; and
   a photovoltaic device viewing the heater element for generating the total power required for opening the fuel control valve when the heater element emits sufficient radiation to surpass a selected output from the photovoltaic device;
   an emissive element remote from the heater element for heating by a burner flame; and
   a second photovoltaic device viewing the emissive element for maintaining the valve open when the power from the second photovoltaic device is sufficient for maintaining the valve open with no other source of electric power.

6. A fuel control system as recited in claim 5 further comprising means for discontinuing heating of the heater element when power from the second photovoltaic device is greater than the selected threshold.

7. A fuel control system as recited in claim 5 further comprising:
   means for discontinuing the current through the heater element when power from the second photovoltaic device is greater than a selected threshold.

8. A fuel control system as recited in claim 5 wherein the heater element comprises a silicon carbide resistance heater.

9. A fuel control system as recited in claim 5 further comprising:
   means for selectively closing a fuel control valve when the power from the second photovoltaic device is less than a selected threshold.

10. A fuel control system as recited in claim 9 further comprising means for discontinuing heating of the heater element when power from the second photovoltaic device is greater than the selected threshold.

11. A fuel control system as recited in claim 9 further comprising means for storing electric current and means for connecting the second photovoltaic device to the means for storing current for charging the means for storing current, said means for storing current being connected to the heater element for passing current therethrough.

12. A gas burning appliance comprising:
   a burner;
   an electrically actuated valve for delivering gas to the burner;
   an electrically heated emissive igniter;
   a photovoltaic device viewing the emissive igniter; and
   means interconnecting the photovoltaic device and the valve for opening the valve and holding the valve open with no other source of electric power when the power from the photovoltaic device is sufficient for opening the valve.

13. An appliance as recited in claim 12 wherein the igniter comprises an electrically resistive heater element composed of silicon carbide or similar material.

14. An appliance as recited in claim 12 further comprising:
   an emissive element positioned to be heated by the flame from the end of the burner remote from the igniter; and
   a second photovoltaic device viewing the emissive element for proving combustion.

15. An appliance as recited in claim 14 further comprising means for closing the valve in the event power from the second photovoltaic device does not reach a selected threshold a selected interval after the valve is opened.

16. An appliance as recited in claim 14 further comprising means for storing electric current from the second photovoltaic device and for passing electric current through the igniter.

17. A gas burning appliance as recited in claim 14 further comprising means for discontinuing heating of the igniter when power from the second photovoltaic device exceeds a selected threshold.

18. An appliance as recited in claim 17 further comprising means for closing the valve in the event power from the second photovoltaic device does not reach a selected threshold after a selected time after the valve is opened.

19. A fuel control system for a burner comprising:
   an electrically resistive igniter element for igniting fuel;
   a photovoltaic device for viewing the electrically resistive igniter and opening a fuel control valve when the igniter is hot enough to generate sufficient electric power for opening the valve with no other source of electric power;
   a second emitter in the main burner;
   a second photovoltaic device for viewing the second emitter and generating sufficient electric power for holding open the valve with no other source of electric power; and
   means connected to the second photovoltaic device for turning the igniter off when combustion of the fuel will continue without it.

* * * * *